United States Patent [19]

Wakita et al.

[11] Patent Number: 4,857,795

[45] Date of Patent: Aug. 15, 1989

[54] INTERNAL MAGNETIC SHIELD SUPPORT APPARATUS FOR COLOR PICTURE TUBE

[75] Inventors: Shoichi Wakita, Ichihara; Shigemi Hirasawa, Chiba, both of Japan

[73] Assignees: Hitachi, Ltd.; Hitachi Device Eng. Co. Ltd., both of Tokyo, Japan

[21] Appl. No.: 68,410

[22] Filed: Jul. 1, 1987

[30] Foreign Application Priority Data

Jul. 2, 1986 [JP] Japan ..... 61-154028

[51] Int. Cl.[4] ..... H01J 29/02

[52] U.S. Cl. ..... 313/402; 313/404; 313/407; 313/269

[58] Field of Search ..... 313/402, 404, 407, 269

[56] References Cited

U.S. PATENT DOCUMENTS 2,909,687 10/1959 Turk et al. ..... 313/269
3,935,496 1/1976 Gijrath ..... 313/402
4,358,702 11/1982 Gijrath et al. ..... 313/404

FOREIGN PATENT DOCUMENTS 59-27010 8/1984 Japan .
133637 7/1985 Japan ..... 313/407
1029260 7/1983 U.S.S.R. ..... 313/404

*Primary Examiner*—Donald J. Yusko
*Assistant Examiner*—Michael Horabik
*Attorney, Agent, or Firm*—Antonelli, Terry & Wands

[57] ABSTRACT

A novel internal magnetic shield support apparatus for a color picture tube is disclosed, in which a mask frame is fixed on the interior of the periphery of a panel of the color picture tube, an internal magnetic shield is arranged along the inner wall surface of a funnel of the color picture tube, and the internal magnetic shield is secured to the mask frame with a buffer member interposed therebetween.

19 Claims, 2 Drawing Sheets

INTERNAL MAGNETIC SHIELD SUPPORT APPARATUS FOR COLOR PICTURE TUBE

BACKGROUND OF THE INVENTION

The present invention relates to a color picture tube having an internal magnetic shield or, more particularly, to a construction for mounting the internal magnetic shield on a mask frame.

A prior art color picture tube having an internal magnetic shield disclosed in JP-Y2-59-27010 (UM) is known. This construction will be described with reference to FIG. 3. A glass bulb 1 forming a housing includes a panel 1*b* with a phosphor screen 1*a* formed on the interior surface thereof, a funnel 1*c* fusion-bonded to this panel 1*b* by a low-melting-point crystal glass (not shown) and having an interior conductive film (not shown) on the interior surface thereof, and a neck 1*d* coupled to the funnel 1*c*.

The panel 1*b* has arranged therein a shadow mask 3 which selects an electron beam from an electron gun 2 disposed on the neck 1*d* and causes the electron beam to impinge on the phosphor screen 1*a*. A peripheral skirt of this shadow mask 3 is secured to a mask frame 4. An end of a spring plate 5 is fusion-bonded to several points along the periphery of the mask frame 4, and the other end of the spring plate 5 is formed with a hole which is adapted for engaging a support pin (not shown) provided on the interior surface of the peripheral part of the panel 1 so that the mask frame 4 is supported by the panel 1*b*. Also, an internal magnetic shield 6 extending toward the neck 1*d* is fixed by a fixing spring 7 on a flange 41 of the mask frame 4. This belt-like fixing spring 7 is bent into the shape shown. The ends 71, 72 of this spring 7, as illustrated in FIG. 4, are held against the spring pressure and inserted into rectangular holes formed in the flange 41 of the mask frame 4 and the flange 61 of the internal magnetic shield 6, after which the fixing spring is released, thereby securing the internal magnetic shield 6 on the mask frame 4 by spring action. The internal magnetic shield 6 is secured to the frame 4 by the fixing spring 7 before the funnel 1*c* is fusion-bonded to the panel 1*b*.

In the aforementioned prior art apparatus, the internal magnetic shield 6 is only kept in pressure contact with the mask frame 4 by the fixing spring 7, and therefore, an external force such as a vibration that may be exerted on the glass bulb 1 would cause the mask frame 4 and the internal magnetic shield 6 to slide with each other at the coupling thereof. As a result, the blackened film ($Fe_3O_4$) formed on the surface of the mask frame or the internal magnetic shield would be damaged and separated, or burrs that may have been created during the processing of the flanges 41, 61 might be separated. Small pieces of burrs and blackened film thus separated, if attached to the shadow mask 3, would clog the mask aperture, or if attached to an electrode, would induce a spark.

SUMMARY OF THE INVENTION

The object of the present invention is to provide a color picture tube in which the mask frame and the internal magnetic shield are prevented from sliding with each other, thereby preventing the blackened film or burrs from separating.

This object is achieved by an apparatus in which a buffer member is interposed between the mask frame and the internal magnetic shield thereby to fix the mask frame and the internal magnetic shield to each other.

DESCRIPTION OF THE PREFERRED EMBODIMENTS

Figure 1:
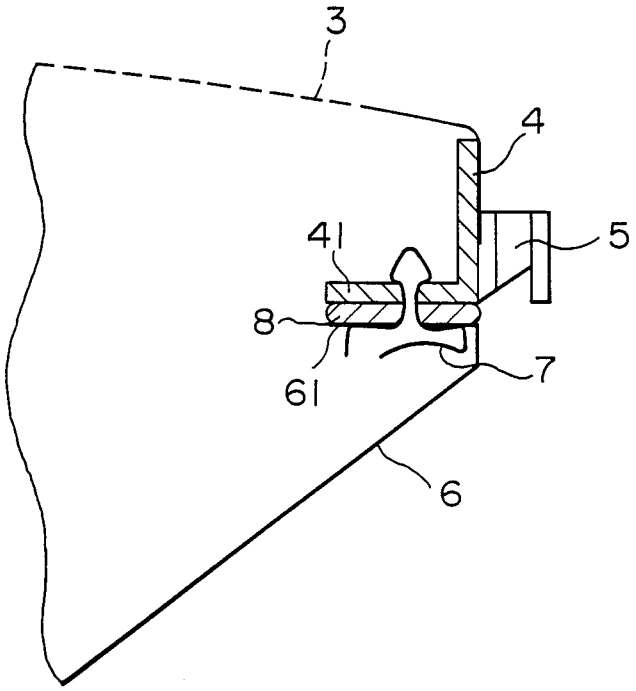
FIG. 1 is an enlarged sectional view of the essential parts of an embodiment of the present invention.
Figure 3:
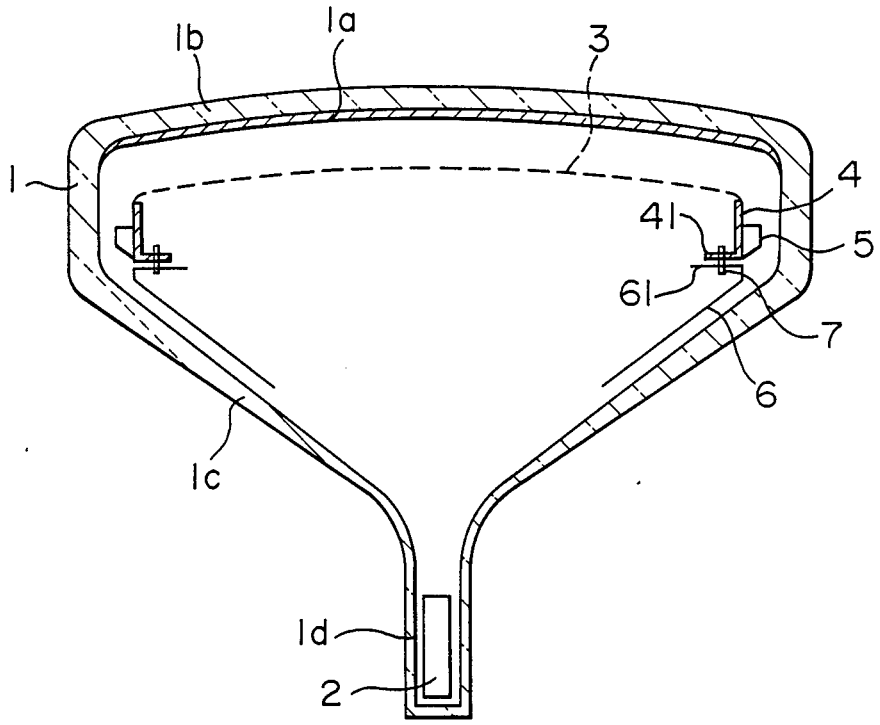
FIG. 3 PRIOR ART
FIG. 3 is a diagram showing a conventional apparatus relevant to the present invention.
Figure 4:
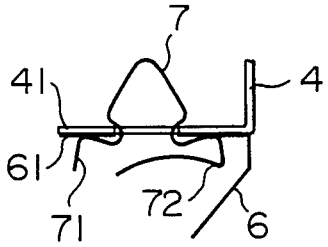
FIG. 4 PRIOR ART
FIG. 4 is an enlarged view showing the essential parts of the apparatus of FIG. 3.

An embodiment of the present invention will be described below with reference to FIG. 1. In FIG. 1, those members identical or equivalent to members in FIG. 3 are designated by the same reference numerals as those in FIG. 3 and will not be described.

A buffer member 8 is interposed between a flange 41 of a mask frame 4 and a flange 61 of an internal magnetic shield 6. After the internal magnetic shield 6 is mounted on the mask frame 4, a panel 1*b* and a funnel 1*c* are fusion-bonded to each other, so that heat applied at the time of fusion bonding is transmitted also to the buffer member 8. As a result, the buffer member 8 is required to be made of a heat-resistant material that can stand the temperature of 450° C. for an hour. Also, in view of the fact that the buffer member 8 is interposed between the mask frame 4 and the internal magnetic shield 6, which is made of a hard metal such as iron, in order to prevent them from being brought into contact with each other, it is necessary that the buffer member 8 be made of a material higher in flexibility than the particular hard metal. Preferably, the buffer member 8 has both flexibility and elasticity.

A proper material suitable for the buffer member having such properties includes aramid fiber or copper. The buffer member made of a sheet of such a material is inserted between the flange 41 of the mask frame 4 and the flange 61 of the internal magnetic shield 6, and secured by the fixing spring 7. Another buffer member 8 is preferably fixedly interposed by adhesive between the flanges 41 and 61 at the corner of the mask frame 4. The buffer member 8 interposed between the flanges 41, 61 is subjected to a compressive force by the spring action of the fixing spring.

The buffer member 8, thus inserted between the mask frame 4 and the internal magnetic shield 6 functions like a kind of damper, thus preventing the mask frame 4 and the internal magnetic shield 6 from being in direct contact with each other, with the result that the blackened film or burrs are not released by sliding or impacts. This reduces the adverse effect on the characteristics of the color picture tube. Further, the contact over the plane instead of at points strengthens the manner in which the internal magnetic shield is fixed, thus providing a construction which is more resistant to vibrations. That is, the separate buffer member which is characterized as having both flexible and elastic properties for effecting damping, such as for absorbing vibratory movement, is secured by a fixing spring, for example, wherein the contacting surfaces between the buffer member and the mask frame, on the one hand, and that of the internal magnetic shield and the buffer member, such as at the flanges, on the other hand, become parallelly directioned contacting surface planes.

Further, according to the present invention, a buffer member is only interposed between the mask frame and the internal magnetic shield to fix the latter two members to each other, and therefore separation of the blackened film is prevented effectively without changing the production processes. Such deleterious separation of the blackened film is prevented, as indicated above, by fixing the relative positioning of the mask frame with respect to the internal magnetic shield by interposing therebetween, and securing with a fixing spring, a buffer member which is both flexible and elastic so that any vibratory action occurring would be absorbed by it. Therefore, any relative sliding, i.e., frictional movement, between the surfaces would be prevented, e.g., between the buffer member contacting surfaces and the respective mask frame and internal magnetic shield flange surfaces. Accordingly, the internal magnetic shield is more effectively secured with the mask frame by employing such a buffer member and is more resistant to separation of the blackened surface or burrs.

Figure 2:
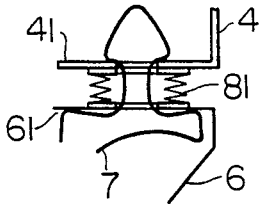
FIG. 2 is a diagram showing another embodiment of the present invention.

Another embodiment of the present invention is shown in FIG. 2. This embodiment comprises a bellows 81 formed of such a heat-resistant and flexible material as copper as a buffer member 8.

In place of the above-mentioned buffer members, any other materials having a heat resistance and flexibility may of course be used for the same purpose without departing from the spirit and scope of the present invention.

We claim:

1. An internal magnetic shield support apparatus for a color picture tube, comprising: a mask frame secured to the interior surface of the periphery of a panel of the color picture tube, an internal magnetic shield arranged along the interior wall surface of a funnel of the color picture tube, and means including a fixing spring for fixedly positioning the internal magnetic shield to the mask frame and having a separate buffer member of a flexible material interposed therebetween so as to prevent contact between said internal magnetic shield and said mask frame, said buffer member having a pair of main surfaces respectively facing and in contact with said mask frame and said internal magnetic shield when they are fixedly positioned, and said buffer member being of such flexible material and disposed such that sliding between its main surfaces and said mask frame and said internal magnetic shield, respectively, is substantially prevented.

2. An apparatus according to claim 1, wherein said buffer member is made of a heat-resistant material.

3. An apparatus according to claim 1, wherein said buffer member is made of aramid fiber.

4. An apparatus according to claim 1, wherein said buffer member is made of a sheet of copper.

5. An apparatus according to claim 1, whrein said buffer member comprises a bellows made of material which is both heat-resistant and flexible.

6. An internal magnetic shield support apparatus for a color picture tube, comprising: a mask frame secured to the interior surface of the periphery of a panel of the color picture tube, an internal magnetic shield arranged along the interior wall surface of a funnel of the color picture tube, and means including a fixing spring for fixedly positioning the internal magnetic shield to the mask frame with a separate buffer member made of a flexible material interposed therebetween so as to prevent contact between said internal magnetic shield and said mask frame, said buffer member which is of a flexible material having a pair of substantially flat main surfaces on opposite sides thereof respectively facing and in contact with a substantially flat contact surface of said mask frame and a substantially flat contact surface of said internal magnetic shield when they are fixedly positioned such that both the main surfaces of said buffer member and the contact surfaces of said mask frame and said internal magnetic shield become parallelly directioned contacting surfaces wherein sliding between said main surfaces and the contact surfaces of said mask frame and said internal magnetic shield, respectively, is substantially prevented.

7. An apparatus according to claim 6, wherein said buffer member is made of a heat-resistant material.

8. An apparatus according to claim 6, wherein said buffer member is made of flexible and elastic material.

9. An apparatus according to claim 6, wherein said buffer member is made of aramid fiber.

10. An apparatus according to claim 6, wherein said buffer member is made of a sheet of copper.

11. An apparatus according to claim 6, wherein said buffer member comprises a bellows made of material which is both heat-resistant and flexible.

12. An apparatus according to claim 6, wherein said mask frame and said internal magnetic shield have securing flanges and said buffer member is fixedly interposed by adhesion to respective surfaces of said flanges.

13. An internal magnetic shield support apparatus for a color picture tube, having a panel and a funnel shaped section comprising: a mask frame secured to the interior surface of the periphery of said panel of the color picture tube, an internal magnetic shield arranged along the interior wall surface of said funnel shaped section, each of said mask frame and said internal magnetic shield having a flange protruding radially inwardly with respect to said picture tube and together having substantially flat surfaces facing each other, and means for securing said internal magnetic shield to said mask by fixedly positioning the relative positions of said flanges with a positionally fixing spring effecting a pressing action therebetween and including a separate buffer member made of flexible material having a pair of substantially flat main surfaces on opposite sides thereof disposed between said facing flange surfaces wherein when said mask frame and said internal magnetic shield are fixedly positioned together with said buffer member, each of said facing surfaces effecting contact with a respective one of said pair of main surfaces of said buffer member such that both the main surfaces of said buffer member and the flange surfaces of said mask frame and said internal magnetic shield become parallelly directioned contacting surfaces wherein sliding between said main surfaces and the flange surfaces of said internal magnetic shield and said mask frame, respectively, is substantially prevented.

14. An apparatus according to claim 13, wherein said buffer member is made of a heat-resistant material.

15. An apparatus according to claim 13, wherein said buffer member is made of flexible and elastic material.

16. An apparatus according to claim 13, wherein said buffer member is made of aramid fiber.

17. An apparatus according to claim 13, wherein said buffer member is made of a sheet of copper.

18. An apparatus according to claim 13, wherein said buffer member comprises a bellows made of material which is both heat-resistant and flexible.

19. An apparatus according to claim 13, wherein said buffer member being fixedly interposed to said respective mask frame and internal magnetic shield flange surfaces by adhesion.

* * * * *